US009114547B2

(12) United States Patent
Kinsler

(10) Patent No.: US 9,114,547 B2
(45) Date of Patent: Aug. 25, 2015

(54) PLANER CLAMP ASSEMBLY

(76) Inventor: Michael J. Kinsler, Warren, MI (US)

( * ) Notice: Subject to any disclaimer, the term of this patent is extended or adjusted under 35 U.S.C. 154(b) by 1196 days.

(21) Appl. No.: 13/050,840

(22) Filed: Mar. 17, 2011

(65) Prior Publication Data

US 2011/0226384 A1 Sep. 22, 2011

Related U.S. Application Data

(60) Provisional application No. 61/315,384, filed on Mar. 18, 2010.

(51) Int. Cl.
*B25B 1/20* (2006.01)
*B27C 1/14* (2006.01)

(52) U.S. Cl.
CPC ..... *B27C 1/14* (2013.01)

(58) Field of Classification Search
USPC ..... 269/37, 43, 45
See application file for complete search history.

(56) References Cited

U.S. PATENT DOCUMENTS 4,031,932 A 6/1977 Leasure
4,341,375 A * 7/1982 Romanin ..... 269/43
4,372,358 A 2/1983 Glore
4,448,406 A * 5/1984 Hallberg et al. ..... 269/224
4,624,294 A 11/1986 Robinson et al.
4,627,478 A 12/1986 Gamble
5,301,726 A 4/1994 Wojcik
6,708,593 B1 3/2004 Weselyk
7,147,412 B2 * 12/2006 Davis ..... 408/115 R
2009/0088053 A1 * 4/2009 Hummel ..... 451/380

OTHER PUBLICATIONS

No Author Listed, "5 tips to get more From a Planer", ShopNotes, Jan. 2010, pp. 44-45, vol. 19 Issue 109, August Home Publishing, Des Moines, Iowa.

* cited by examiner

*Primary Examiner* — Lee D Wilson
*Assistant Examiner* — Shantese McDonald
(74) *Attorney, Agent, or Firm* — Mastrogiacomo PLLC

(57) ABSTRACT

A planer clamp assembly includes a pair of side rails, a pair of clamps having at least one hole, at least one leveler, the leveler including a screw and a cam, the cam including a lobe and the cam being configured to raise and lower the screw in a generally perpendicular direction with respect to the clamps when the cam is rotated about a generally parallel axis with respect to the clamps and at least one bar. The bar is configured to be secured between the pair of side rails. Each of the holes included in the pair of clamps are configured to slidably accept the bar thereby allowing the pair of clamps to slide freely about the bar between the pair of side rails.

17 Claims, 14 Drawing Sheets

PLANER CLAMP ASSEMBLY

CROSS REFERENCE TO RELATED APPLICATIONS

This patent application claims the benefit of priority based on U.S. Provisional Patent Application No. 61/315,384 filed on Mar. 18, 2010, which is incorporated by reference in its entirety for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to woodworking planers and, more particularly, to a planer clamp assembly used to secure and position a piece of rough sawn lumber such that the lumber may be passed through the planer to be milled.

2. Background Art

Woodworkers and others using wood to create toys, furniture and the like often begin their projects with a piece of rough sawn wood or lumber. It is generally far more economical to begin a woodworking project with a piece of rough sawn lumber or wood rather than lumber that has already been milled to a certain specification by a wood mill. Thickness planers are one tool that has been used by woodworkers for many years as a means of smoothing and leveling a piece of rough sawn lumber. Typically, planers are a second or third step in the evolution of preparing a piece of rough sawn lumber for use in woodworking projects.

In general, the evolution of a piece of rough sawn lumber begins with a jointing function to establish a datum or flat surface. Typically, an edge may be jointed with the jointer to create an edge datum. Once the edge datum is established a surface of the wood may be run through the jointer to create a surface datum. Many passes though the jointer may be completed in an attempt to create a very flat and straight edge or surface. The initial edge datum and surface datum may be critical because the edge and surface will be the starting point for the development of the second edge and surface and the production of a final piece of lumber that may be used in a woodworking project.

Once the datums have been established, a table saw or the like may be used to create a second flat and straight edge. In this operation, the first edge is placed against a flat straight metal fence that extends parallel to the saw blade and allows the first edge to pass along the fence as the second edge is created by the saw blade. Allowing the first edge to travel along the flat and straight fence may produce the same flat and straight second edge.

With both edges established as well as a first surface, the piece of lumber or wood may now be passed though a planer to create a second flat and level surface. Typically, the piece of lumber may be positioned on a flat, straight surface or table that is connected to or positioned near the planer. Often, a wood planer may require that an initial surface datum be established so that the surface datum may be fed along the table surface. Allowing the first surface or datum of the wood to be placed on the table and fed into the planer along the table may produce the same flat, level straight second surface. The cutting tools of the planer will remove the high spots of the second surface. The piece of lumber may be fed into the planer several times to create a flat level second surface. Once a satisfactory surface has been attained, the piece of lumber may now be ready to be used in creating the toy, piece of furniture and the like. If the initial edge and surfaces are not milled to be level, smooth and straight, the second edge and surface may not be level, smooth and straight either and the piece of lumber may be useless for any project.

While the above steps or operations have been used for many years to create a finished piece of lumber ready for use in creating a piece of woodwork, there are, however, several drawbacks. First, the width of a piece of lumber that may be used in woodworking may be limited to the size of jointer and planer in use. For example, if the width of the jointer is six inches, the width of the board that may be milled is limited to six inches. While jointers of varying width may be purchased, there may be a limit to the size of the jointer due to space concerns in a small workshop and of course the expense of purchasing and operating larger equipment. The limited width of boards may be a concern in the creating of table tops. Being limited by narrow widths may mean that many of the boards may have to be assembled together to create a wider table top. For instance, if a project calls for a table top having a width of twenty-four inches, four six inch boards would need to be assembled together to create the table top thus leading to extra work to do so and a possible loss of strength at the joints as well.

Second, the surface datum created by a jointer is often dependent on the skill of the operator as well as the jointer itself. An operator generally guides the piece of wood or lumber across the jointer table and cutting blades. If the operator is not skilled and/or careful, many passes over the jointer may be required to create the smooth surface which may result in a loss of time and wasted material.

Third, as described above, the milling of a piece of rough sawn lumber may require up to three separate pieces of wood milling equipment: a jointer, a table saw and a planer. The ability to remove a single piece of equipment from the equation may free up shop space and reduce expenses to allow one to purchase a single larger piece of woodworking equipment so that larger pieces of rough sawn lumber may be milled for larger projects.

Therefore, a need exists for a woodworking planer clamp assembly that may be sized to secure and level a piece of rough sawn lumber so that the lumber may pass though a woodworking planer to create a level surface datum. The planer clamp assembly may also limit operator involvement in the planing operation and may eliminate the need for a jointing operation to create a surface datum.

BRIEF SUMMARY OF THE INVENTION

A planer clamp assembly for positioning and securing a piece of wood and other materials such as steel, plastic and the like is provided that includes a pair of side rails, a pair of clamps having at least one hole, at least one leveler, the leveler including a screw and a cam, the cam including a lobe and the cam being configured to raise and lower the screw in a generally perpendicular direction with respect to the clamps when said cam is rotated about a generally parallel axis with respect to the clamps and at least one bar. The bar is configured to be secured between the pair of side rails. Each of the holes included in the pair of clamps are configured to slidably accept the bar thereby allowing the pair of clamps to slide freely about the bar between the pair of side rails.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
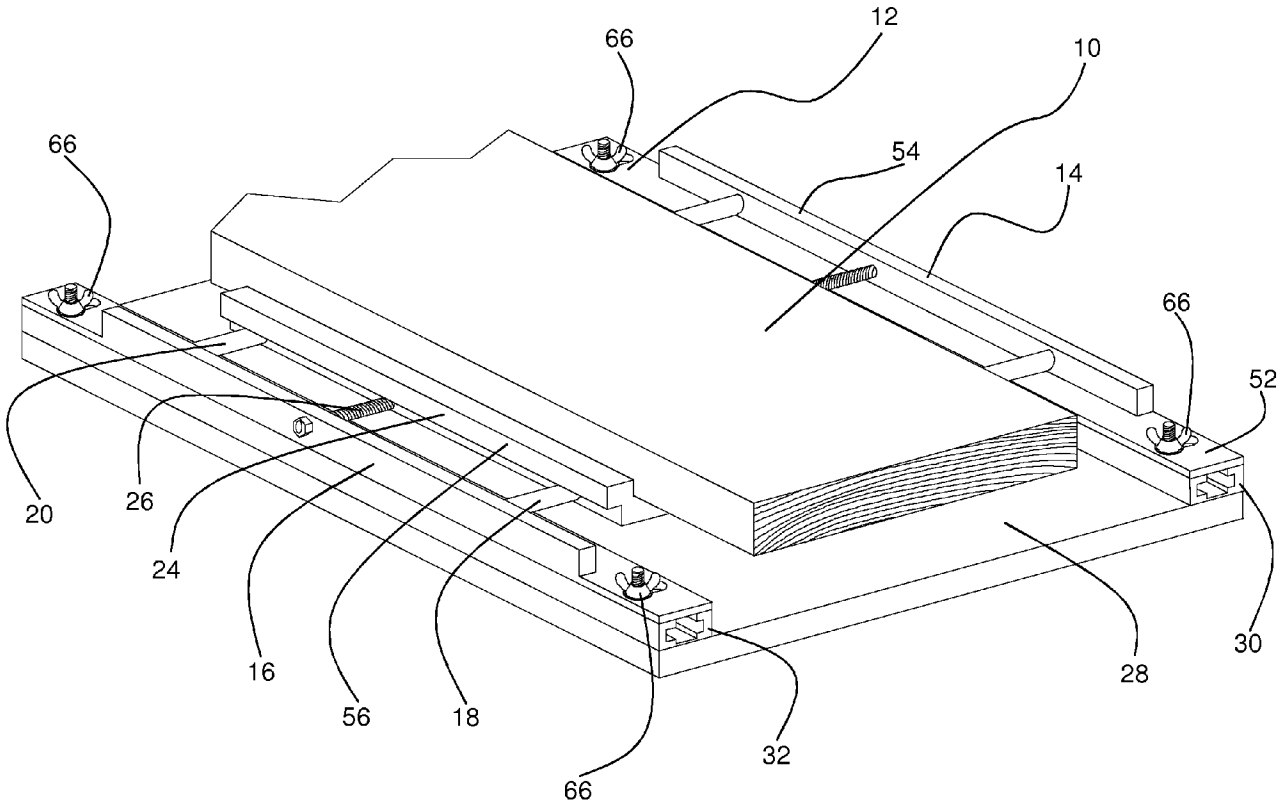
FIG. 1 is a perspective view of a planar clamp assembly shown positioning and securing a piece of lumber according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

Wood planers have been used by saw mills, woodworkers and the like to smooth and level the surface and decrease the thickness of rough sawn lumber for many years. Typically, the use of a planer is one step in a multi-step operation to smooth and level the surfaces and edges of a piece of rough sawn lumber to prepare the lumber for use in woodworking projects. Generally, a piece of lumber may be fed into the front of the planer (see e.g. FIG. 2) as one of a number of steps to prepare the lumber. As the lumber passes through the planer, a number of blades engage the top surface of the wood to remove the high areas from the surface of lumber to create a level smooth top surface.

Figure 2:
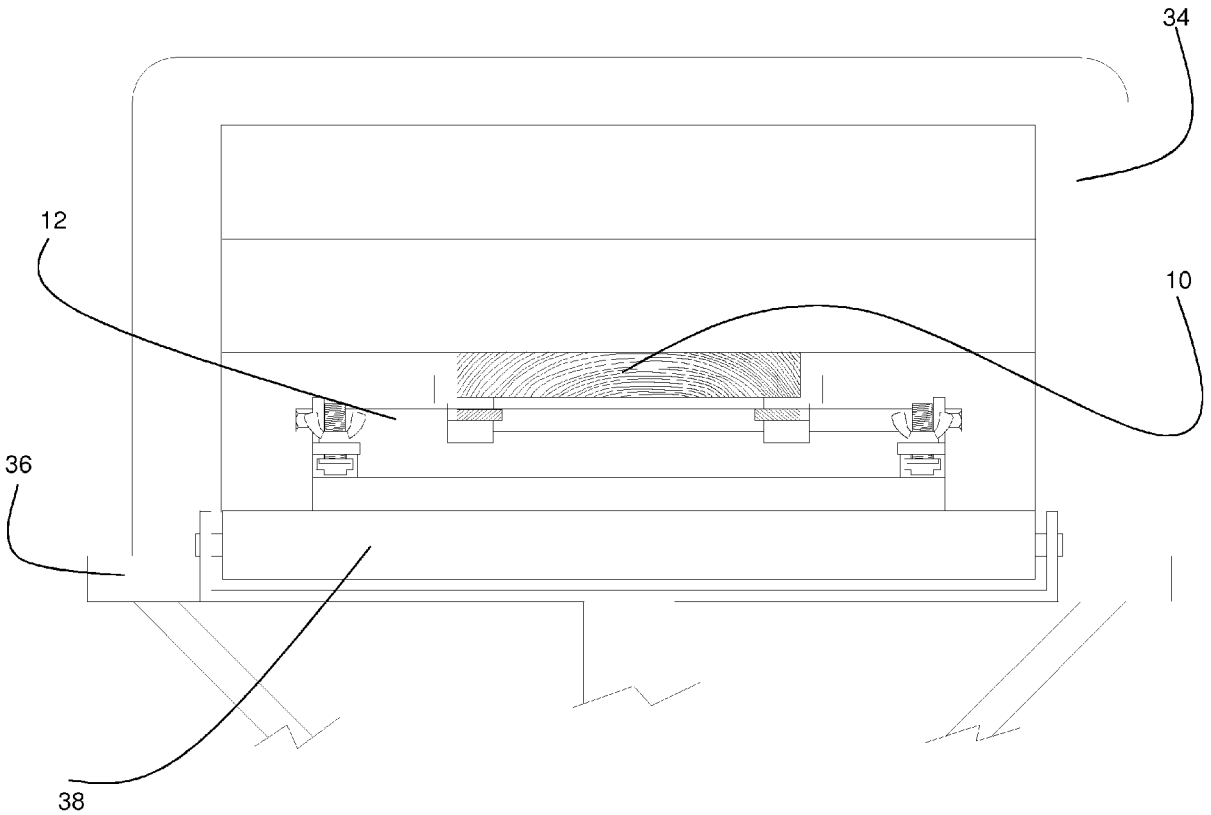
FIG. 2 is a front view of the planer clamp assembly shown positioning and securing a piece of lumber as the clamp assembly and lumber are fed into a planer according to an embodiment of the present invention.

Referring now to FIGS. 1 and 2, a piece of rough sawn lumber or wood 10 is shown positioned and secured to a planer clamp assembly 12. Clamp assembly 12 is generally configured to position and secure wood 10 so that both clamp assembly 12 and wood 10 may be fed through a typical wood planer 34. As the planer clamp assembly and the piece of lumber are fed thorough the planer, rotating blades of the planer engage the wood to remove any high points or "peaks" from the top surface of the lumber. Generally, the wood is passed through the planer a number of times until the desired flat smooth surface is produced throughout the top surface of the piece of wood. It is desirable to fashion a piece of wood or lumber in this manner so that the milled wood may be used in any number of wood working projects, such as a table, shelf, toys and the like.

Figure 3:
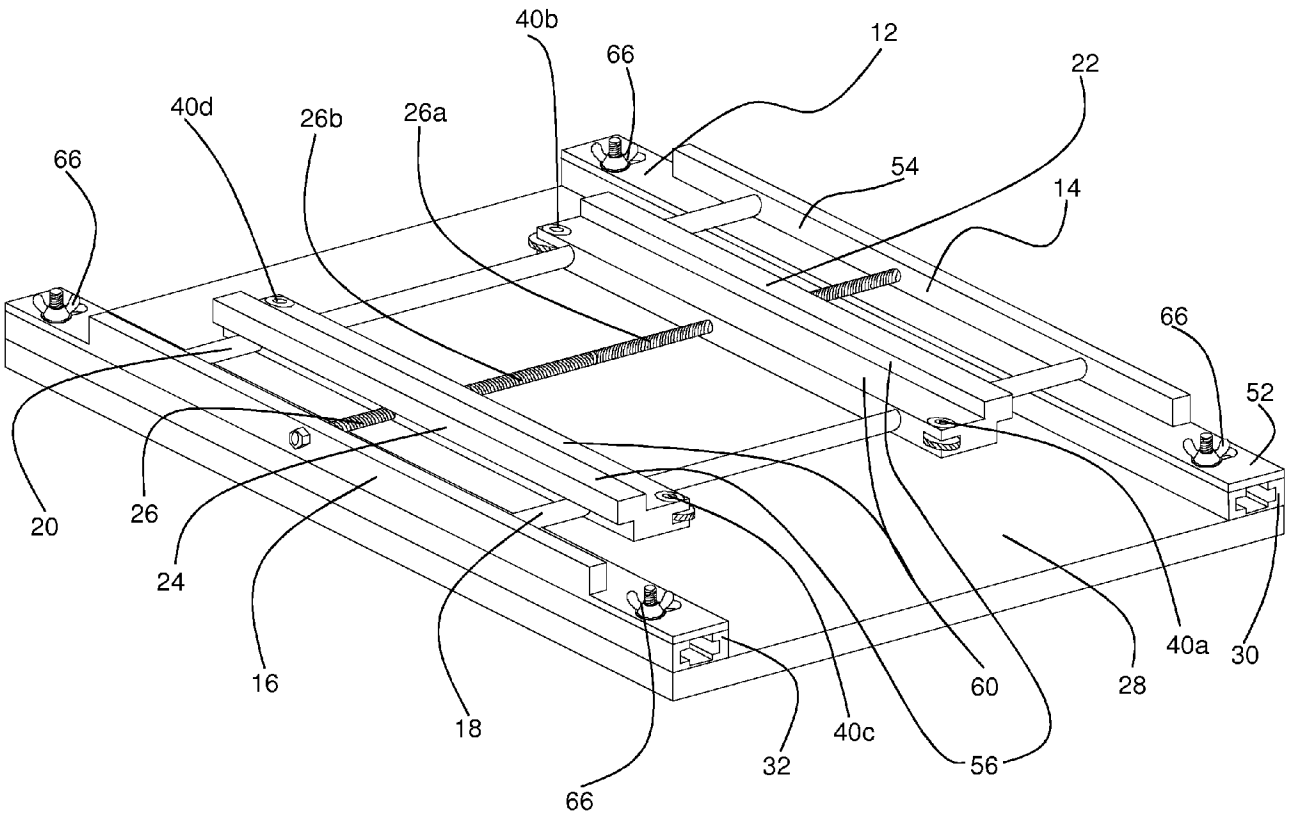
FIG. 3 is a perspective view of the planer clamp assembly according to an embodiment of the present invention.
Figure 4:
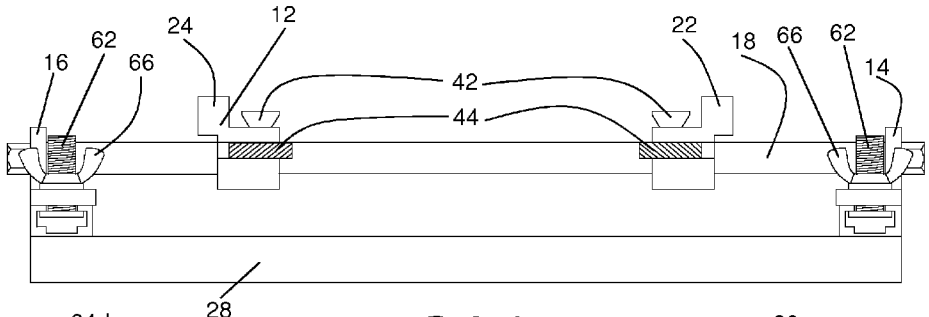
FIG. 4 is a front view of the planer clamp assembly according to an embodiment of the present invention.
Figure 5:
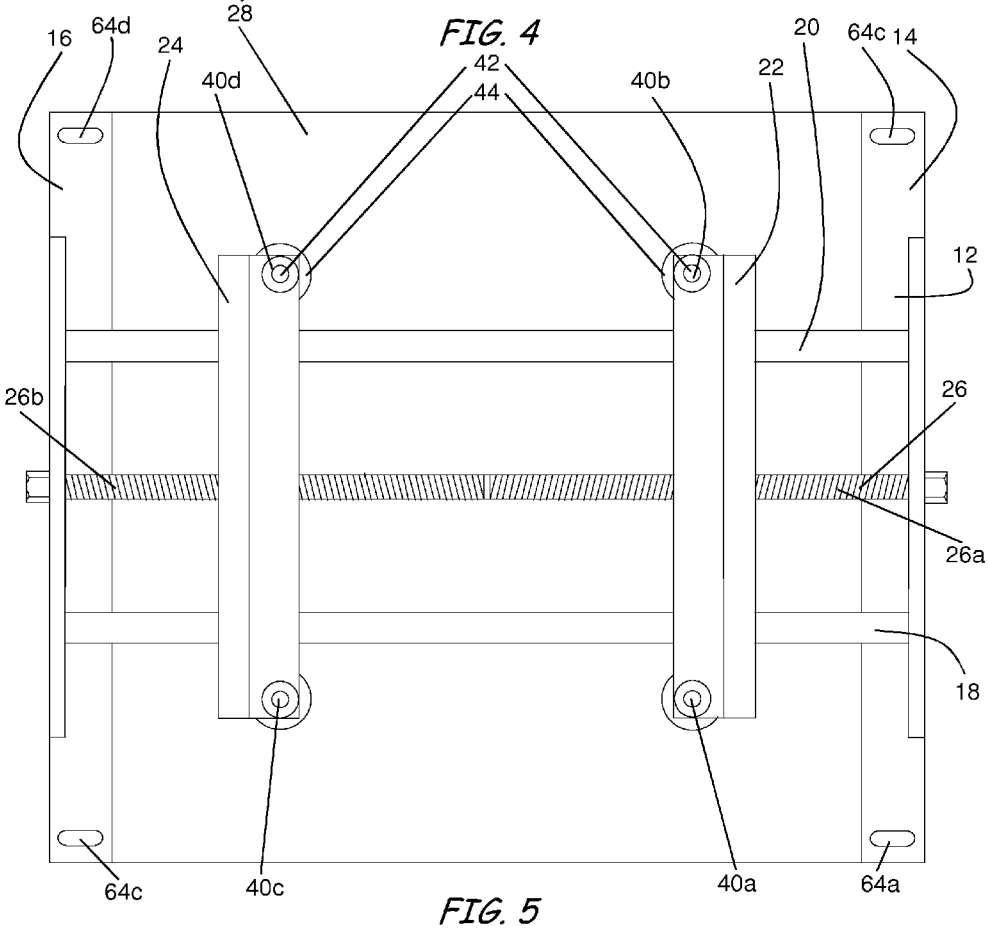
FIG. 5 is a top view of the planer clamp assembly according to an embodiment of the present invention.

FIGS. 3-5 illustrate planer clamp assembly 12 with wood 10 now removed so that clamp assembly 12 may be described in greater detail. Clamp assembly 12 includes a pair of side rails 14, 16. Side rails 14, 16 extend the length of clamp assembly 12 and are typically positioned such that side rails 14, 16 are generally parallel. Side rails 14, 16 each include a base plate 52 and a wall 54. Base plate 52 further include slotted holes 64*a*, 64*b*, 64*c*, 64*d* that are positioned at opposite ends of side rails 14, 16. A wing nut 66 and threaded anchor bolt 62 may be fastened to plate 52 at slotted holes 64*a*-64*d*. Positioned between side rails 14, 16 and secured to walls 54 are bars 18, 20. Bars 18, 20 extend the width of clamp assembly 12. In this particular embodiment, the bars are round; however, it is important to note that the bars may be of any geometric shape such as oval, triangle, square or the like.

Clamp assembly 12 further includes clamps 22, 24. Clamps 22, 24 include holes for accepting bars 18, 20 so that clamps 22, 24 may be secured to clamp assembly 12. The holes of clamps 22, 24 are sized such that the clamps my slide freely on bars 18, 20 about the width of clamps assembly 12. Clamps 22, 24 each include a top surface 60 and a clamping edge 56 both extending the length of each clamp. As shown in FIG. 1, the clamping edges of clamps 22, 24 are used to secure wood 10 to clamp assembly 12. Clamps 22, 24 further include a threaded hole 58 generally positioned in the center of each of clamps 22, 24.

A threaded rod 26 is also included in clamp assembly 12 and is positioned about the width of clamp assembly 12 and generally in the center of side rails 14, 16 and clamps 22, 24. A portion of rod 26 is configured to pass through threaded hole 58 of each of clamps 22, 24. Threaded rod 26 is configured to operate with clamps 22, 24 to position the clamps so that wood 10 may be secured to clamp assembly 12.

Threaded rod 26 may be used to adjust the distance between clamps 22, 24 so that any width of wood 10 may be accommodated and secured in clamp assembly 12. Rod 26 passes through holes in each of side rails 14, 16 and may be allowed to rotate within the holes. A nut or other means may be used to secure rod 26 to side rails 14, 16. As stated above, clamps 22, 24 include threaded holes 58 for engaging the threads of rod 26. In this particular embodiment, first half of rod 26 may be threaded in a right hand configuration up to the approximate center of rod 26 and second half rod 26 may be threaded in a left hand configuration. With rod 26 configured in this manner and the corresponding configuration of the threaded holes of clamps 22, 24 that engage rod 26, clamps 22, 24 will narrow and widen with respect to side rails 14, 16 as rod 26 is rotated in a clockwise and counter clockwise direction.

Although a threaded rod may be used to facilitate the open and closing of clamps 22, 24 about a piece of lumber, there are, however, alternative means that may be used to operate the clamping aspect of the invention. For example, hydraulic or pneumatic features may be added to clamp assembly 12 to facilitate the opening and closing of clamps 22, 24 about the wood. While other means may be used to adjust the width of clamps 22, 24 it is important to note that each perform the same operation according to an embodiment of the present invention, namely positioning clamps 22, 24 to secure or unsecure wood 10 to or from clamp assembly 12.

The components of clamp assembly 12 may be manufactured of any type of material such as steel, aluminum, plastic, nylon and the like. Although clamp assembly 12 may be manufactured of any material, it is important to note, however, that the choice of material should be made such that clamp assembly 12 will provide adequate force to secure a piece of rough sawn lumber as rollers of the planer engage both the lumber and carrier board and the cutting tools of the planer mill the lumber. Planer clamp assembly 12 may be manufactured and sized to work with any width or length of lumber. The clamping and leveling features of clamp assembly 12 are such that they may be used with any type of woodworking tool such as a belt sander, jig saw, drill, and the like.

Figure 8:
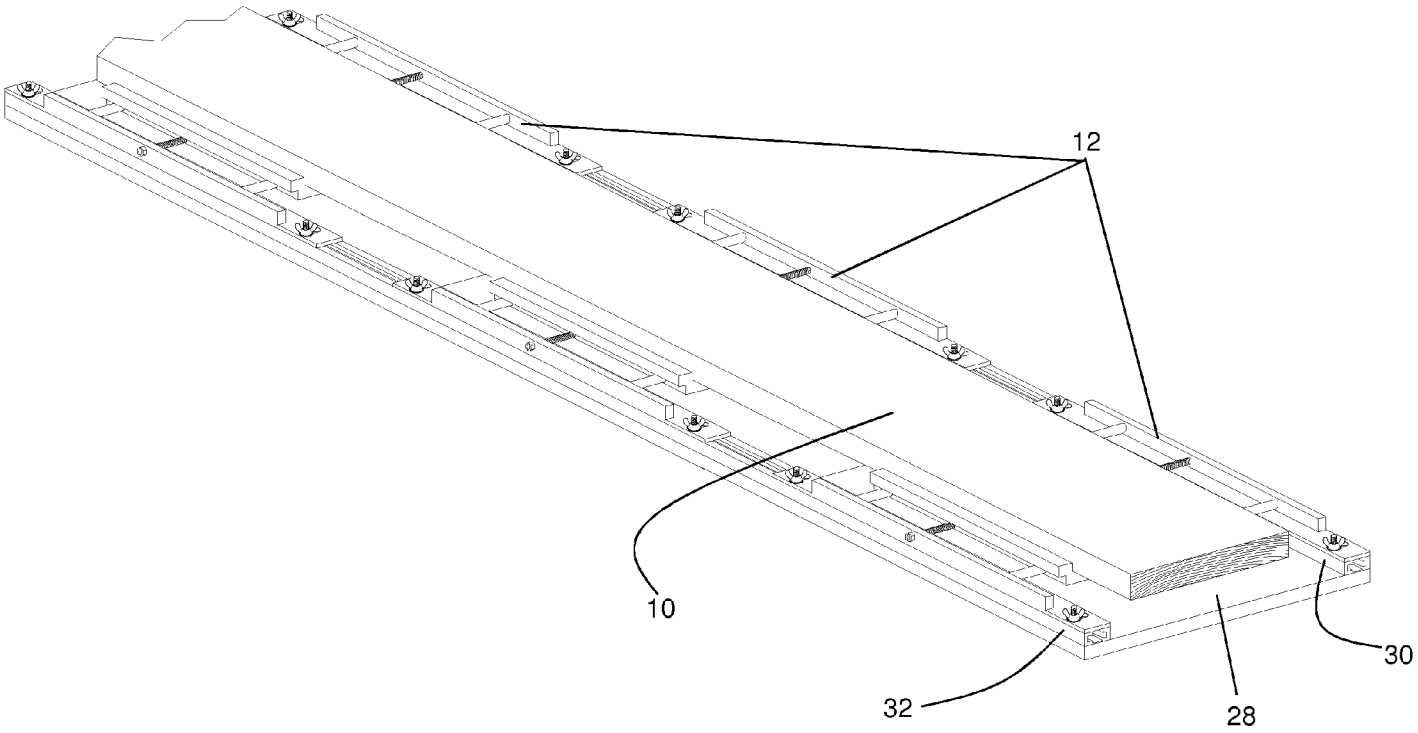
FIG. 8 is a perspective view of multiple planer clamp assemblies shown working in conjunction with one another to position and secure a piece of lumber according to an embodiment of the present invention.

Referring now to FIGS. 1-8, a carrier board 28 is depicted and may be used to position and secure one or multiple clamp assemblies 12 for use in wood planer 34 (See e.g. FIG. 8). Carrier board 28 typically includes top and bottom surfaces that are generally smooth, flat and are parallel to one another and may be manufactured from any type of material such as wood, laminated wood, steel, plastic and the like. Carrier board 28 may include slotted mounts 30, 32 that may be attached to an outer edge of carrier board 28. Mounts 30, 32 typically extend the length of carrier board 28 and may extend generally parallel to one another. Mounts 30, 32 may be secured to carrier board 28 by any means such as typical screws or other fasteners, glue and the like.

As illustrated in FIG. 4, the width of carrier board 28 is generally sized to match the width of clamp assembly 12. Each base plate 52 of side rails 14, 16 may fit atop mounts 30, 32 as clamp assembly 12 is placed on carrier board 28. Slotted holes 64*a*-64*d* of plate 52 are configured to align with the slots of mounts 30, 32. The slots of mounts 30, 32 are configured to accept a head of threaded anchor bolt 62. Once clamp assembly 12 is positioned on carrier board 28, wing nuts 66 may be rotated in a clockwise motion at all four positions to bring the head of anchor bolt 62 into contact with a lip of mounts 30, 32. This will secure clamp assembly 12 to carrier board 28.

Figure 6:
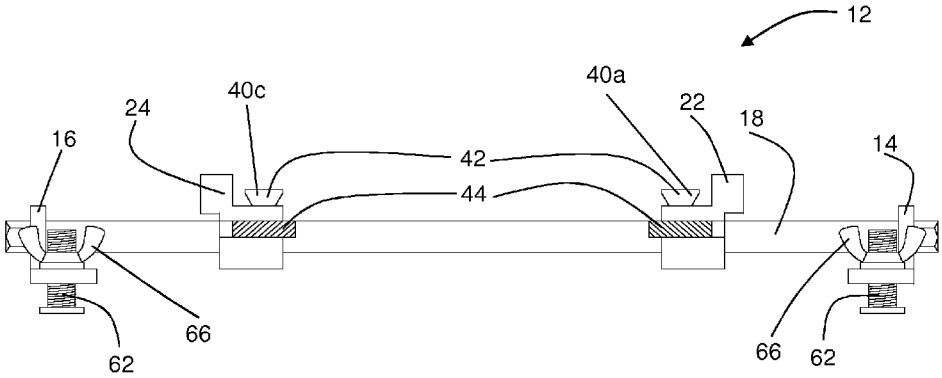
FIG. 6 is a front view of the planer clamp assembly according to an embodiment of the present invention.
Figure 7:
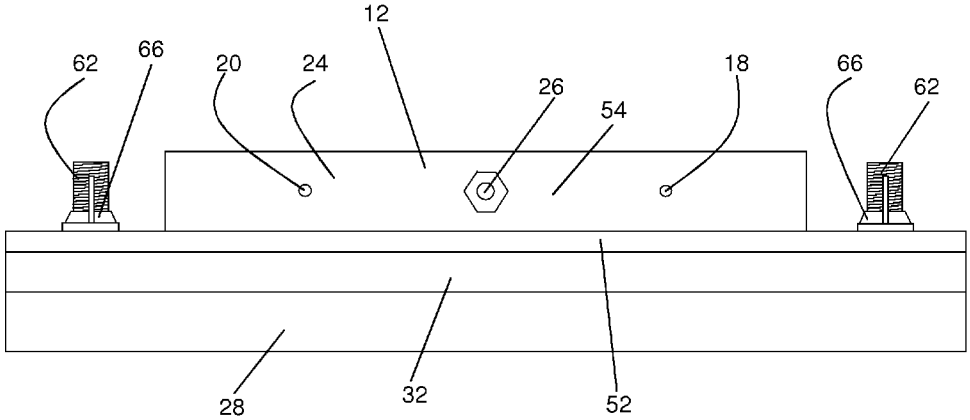
FIG. 7 is a side view of the planer clamp assembly according to an embodiment of the present invention.

FIG. 6 illustrates clamp assembly 12 that is not attached to carrier board 28. This particular embodiment shows wing nut 66 and anchor bolt 62 in an unclamped state such that the nut and bolt assembly may move freely in slotted holes 64*a*-64*d*. Allowing the nut and bolt assembly to move freely, allows one to attach clamp assembly 12 to carrier board 28 by first sliding the head of anchor bolts 62 into the slots of mounts 30, 32. Once clamp assembly 12 is positioned in the desired location, wing nuts may be rotated in a direction that will clamp the head of anchor bolt 62 against the lip of mounts 30, 32 thereby anchoring clamp assembly 12 to carrier board 28. The nut and bolt assemblies in conjunction with the slots allow for clamp assembly 12 to be positioned at any point along the length of carrier board 28 to easily accommodate a piece of lumber of any size.

A typical piece of rough sawn lumber is not generally smooth or flat enough to be used to construct furniture such as a table. Many times, neither the bottom nor the top surfaces are smooth or flat. When a piece of rough sawn lumber is set on a flat surface, the piece of lumber may rock or wobble on the peaks of the particular wood surface. It is not advantageous to introduce a piece of lumber to a planer that "rocks" or is "warped". By doing so, one may not be able to achieve the desired flat, level and smooth surface that may be needed to construct woodworking pieces.

When the rough sawn lumber is introduced to clamp assembly 12, the warped piece of lumber will tend to rock on the surface of clamps 22, 24. FIGS. 3-6 illustrate one means to alleviate the rocking issue. Levelers 40*a*, 40*b*, 40*c*, 40*d* may be included in clamp assembly 12. Levelers 40*a*, 40*b* may be positioned along the length of clamp 22 and typically at opposite ends of clamp 22. Levelers 40*c*, 40*d* may be positioned along a length of clamp 24 and typically at opposite ends of clamp 24. By being positioned at opposite ends of clamp 22, 24, the levelers will provide a maximum distance or span so that when wood 10 is placed on clamps 22, 24 the levelers will engage an end of wood to provide a positive engagement with clamp assembly 12 to account for the rocking effect of a warped piece of wood. With levelers engaged, the top surface of wood 10 will be in a generally flat position for introduction into planer 34. This is important for a number of reasons, namely to ensure a safe working condition and to produce a relatively flat top surface in the wood.

The positioning of the wood on levelers 40*a*, 40*b*, 40*c*, 40*d* may ensure that the top surface of the wood is in a generally flat position so that a first datum may be created in the top surface after passing through the wood planer. Using levelers 40*a*, 40*b*, 40*c*, 40*d* of carrier assembly 12 to position the wood in this manner and create a first level and smooth top surface or datum will eliminate the need to use a jointer to create the top surface datum. Clamp assembly 12 and levelers 40*a*, 40*b*, 40*c*, 40*d* may also eliminate the issues due to operator involvement that often develop when working with a wood jointer.

Figure 9A:
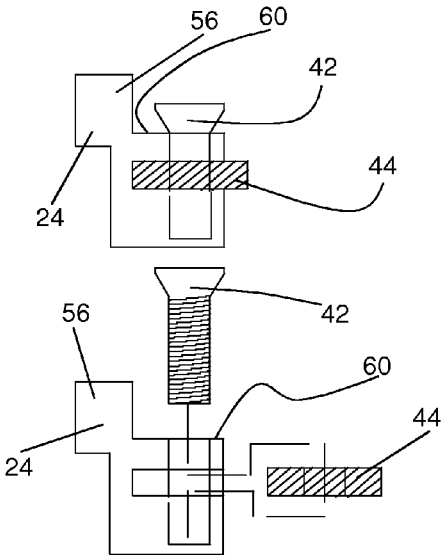
FIGS. 9A-9D depict alternative positioning and leveling means for the planer clamp assembly according to an embodiment of the present invention.

In this particular embodiment of the present invention, levelers 40*a*, 40*b*, 40*c*, 40*d* are configured in the following manner. FIG. 9A illustrates an exploded view of a single leveler. As stated above, the levelers may be attached at either ends of clamps 22, 24. In this particular embodiment, a typical screw 42 may be used as a leveler. A threaded hole is included at opposite ends of clamps 22, 24 for accepting screw 42. Screw 42, in combination with the threaded hole of the clamp allow the screw to be raised and lowered with respect to the clamp in a typical fashion as the screw is rotated in a clockwise and counter clockwise direction in the threaded hole.

When placed in clamp assembly 12, wood 10 may cover the top of screw 42. Therefore, it is advantageous to include means of raising and lowing screw 42 with respect to clamps 22, 24 that will be easily accessible to the individual. In this particular embodiment, a thumb screw 44 may be included with the screw and clamp configuration. Thumb screw 44 includes a threaded hole for accepting and engaging the threads of screw 42. Each of the ends of clamps 22, 24 included a slot for accepting thumb screw 44 such that each of the threaded holes of clamps 22, 24 will align with the threaded hole of thumb screw 44. When all components of the leveler are configured together, thumb screw 44 may be rotated in a clockwise and counter clockwise direction to raise and lower the leveler with respect to the top surface of the clamps. This will provide an individual the means to raise screw 42 to engage a wood 10 when placed on clamp assembly 12.

Figure 10A:
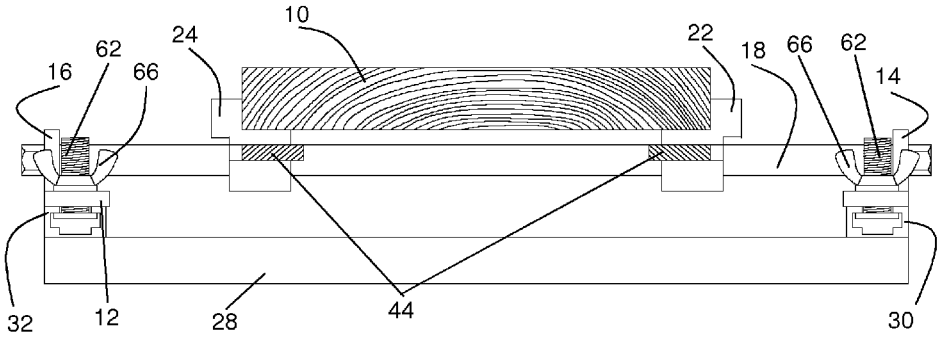
FIGS. 10A-10C are front views of the planer clamp assembly shown positioning a piece of lumber in the clamp assembly according to an embodiment of the present invention.
Figure 10B:
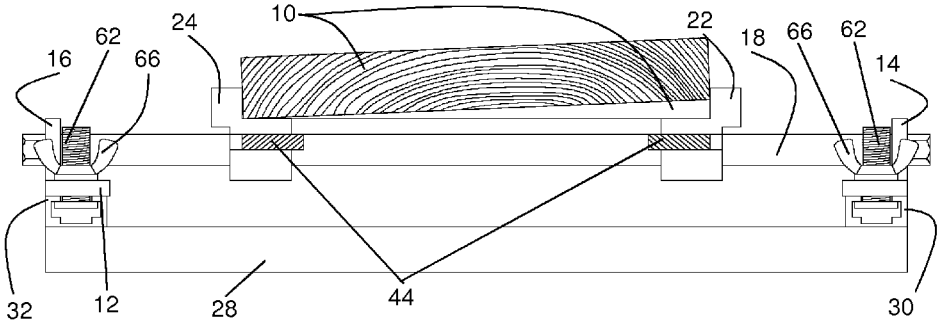
Figure 10C:
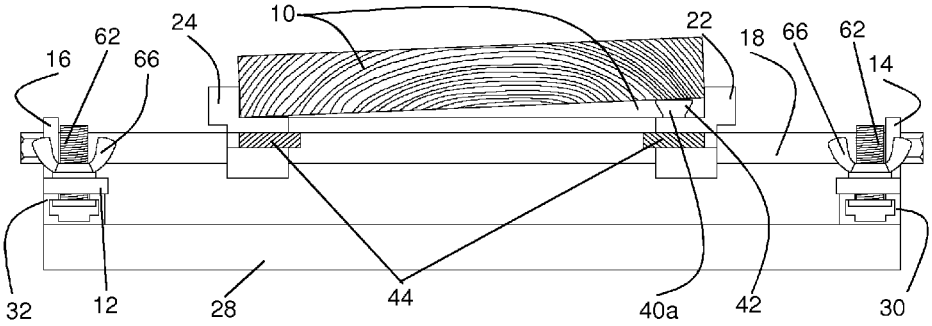

FIGS. 10A-10C illustrate how levelers 40*a*, 40*b*, 40*c*, 40*d* may be used to engage wood 10 to aid in preventing any rocking or wobbling of the wood with respect to clamping assembly 12. FIG. 10A depicts wood 10 resting generally flat against top surface 60 of each clamp 22, 24. In this rare instance, the levelers may not be needed to engage the wood. FIG. 10B illustrates a warped piece of wood that has been set on top surface 60 of clamps 22, 24. In this instance one may readily see the gap that has been left between the bottom surface of wood 10 and top surface 60 of clamps 22, 24. Finally, FIG. 10C shows the leveler engaging wood 10 so that any of the wobbling or rocking may be diminished as the wood is passed through planer 34.

Figure 9B:
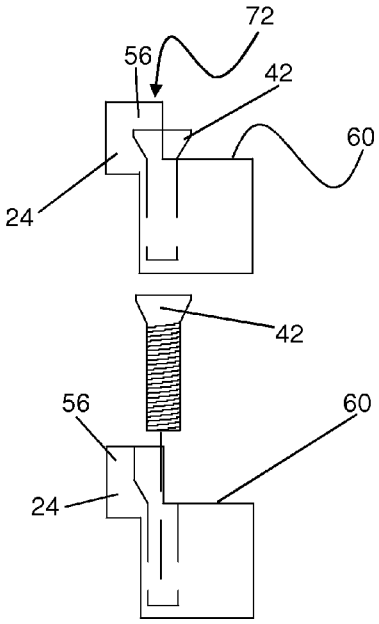
Figure 9C:
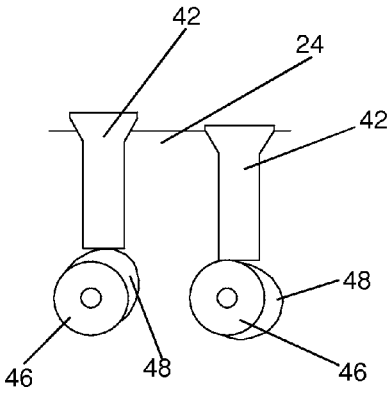
Figure 9D:
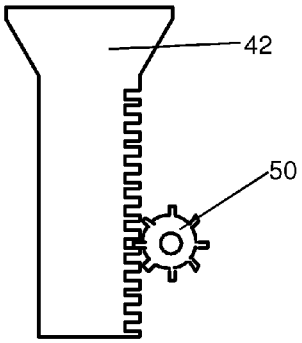

FIGS. 9B-9D illustrate alternative means to raise and lower screw 42 with respect to the top surface of clamps 22, 24. In FIG. 9B, the threaded hole of clamps 22, 24 is off set slightly from the threaded hole of FIG. 9A. In this alternative embodiment of the present invention, a divot 72 may be added to clamping edge 56 of clamps 22, 24 to provide clearance for screw 42 to travel up and down with respect to the top surface of the clamp. Together with the offset threaded hole of the clamp, divot 72 also will allow access to a portion of the top of screw 42. Here a portion of the head of screw 42 will engage wood 10 when placed in clamp assembly 12. Another portion of the head of screw 42 will be exposed so that a tool, such as a hex-head drive, screwdriver, and the like may engage the screw head to lower and raise screw 42 with respect to the top surface of the clamp by rotating the screw in a clockwise and counter clockwise direction.

Figure 11A:
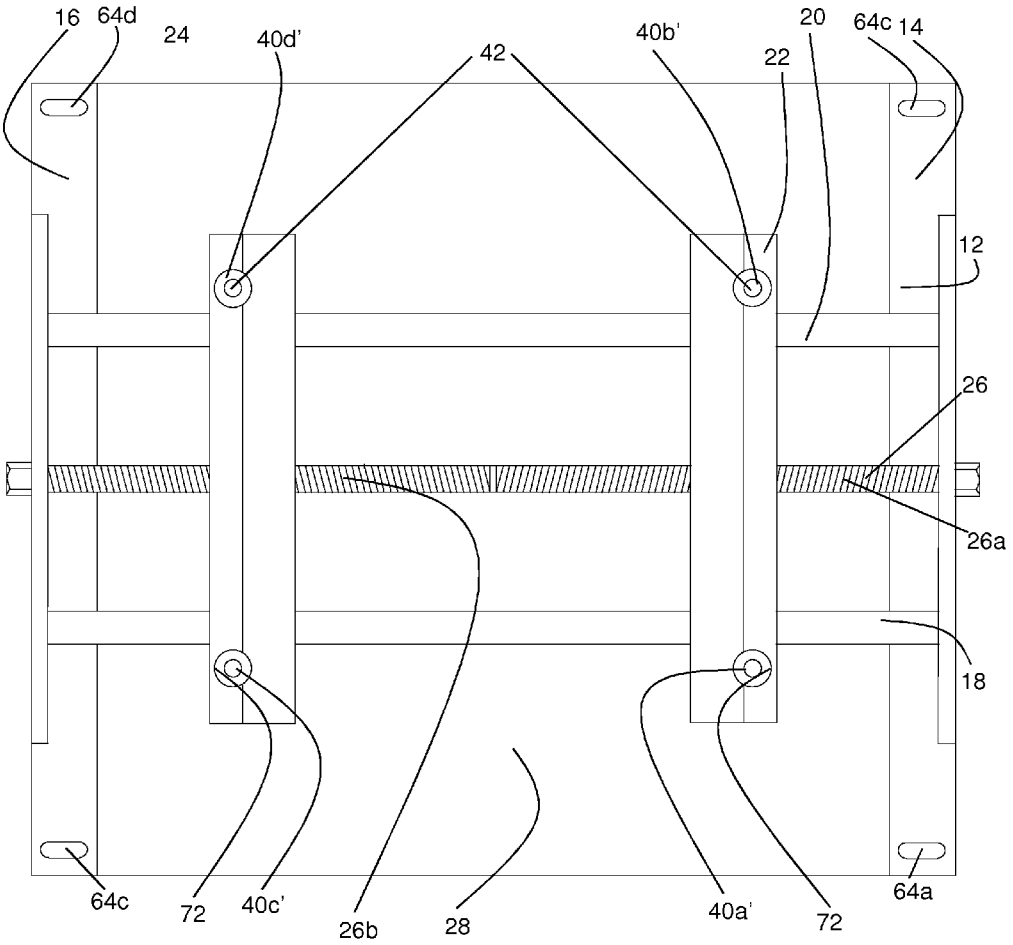
FIG. 11A is a top view of a planer clamp assembly according to another embodiment of the present invention.
Figure 11B:
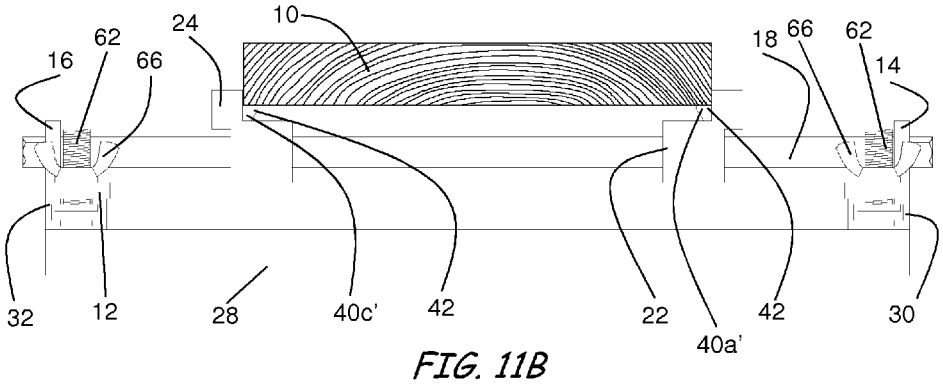
FIG. 11B is a front view of the planer clamp assembly according to another embodiment of the present invention.
Figure 11C:
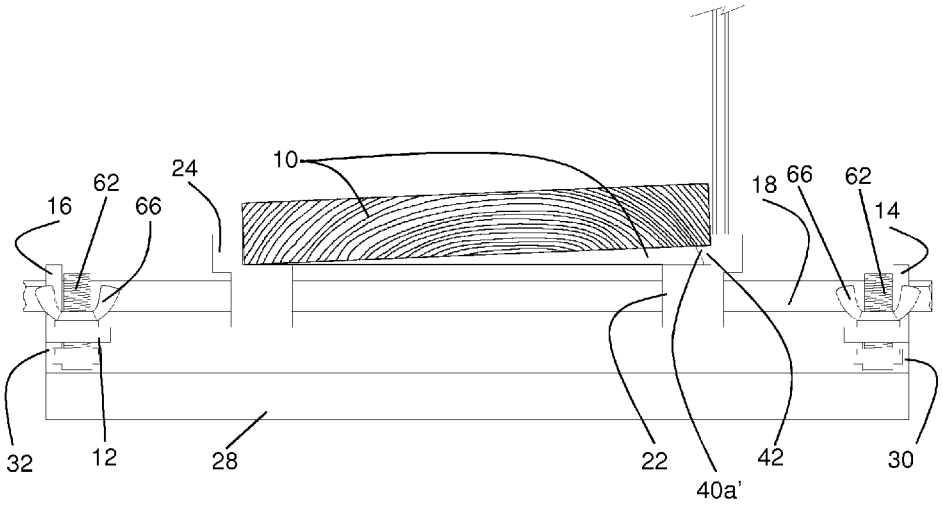
FIG. 11C is a front view of the planer clamp assembly according to another embodiment of the present invention.

FIGS. 11A and 11C illustrate the locations of levelers 40a', 40b' 40c' 40d' with respect to clamps 22, 24. Divots 72 are also shown. Divots 72 provide clearance between the wood and the head of crew 42 so that a tool, such as a hex head drive, may be used to raise and lower screw 42 with respect to top surface 60 of clamp 22. FIG. 11B depicts levelers 40a'-40d' engaging wood 10.

FIG. 9C illustrates a cam actuated leveler. In this particular embodiment of the present invention, cam 46 may be configured to be included in clamps 22, 24 at each leveler position. Cam 46 are generally rounded in shape and include a raised or lobe portion 48 and a lowered portion for engaging the bottom of screw 42 as shown in FIG. 9C. As cam 46 is rotated, lobe 48 engages and disengages the bottom of screw 42 to raise and lower screw 42 with respect to the top surface of clamps 22, 24.

FIG. 9D illustrates a rack and pinion leveler. In this particular embodiment of the preset invention, a pinion 50 may be configured to be included in clamps 22, 24 at each of leveler position. Pinion 50 includes a number of spokes for engaging the rack or teeth that have been added to screw 42. As pinion 50 is rotated, the spokes of pinion 50 engage the teeth of screw 42 to raise and lower screw 42 with respect to the top surface of clamps 22, 24. Any of the means for adjusting the height of the leveler described above may be used to raise and lower screw 42 so that it engages wood 10 when would 10 is placed in clamps 22, 24. Ensuring that wobbling or rocking of a warped piece of wood is diminished prior to the planing operation will aid in creating a finished piece of wood with a flat, smooth top surface that may be readily used in the construction of any type of woodworking.

Figure 12:
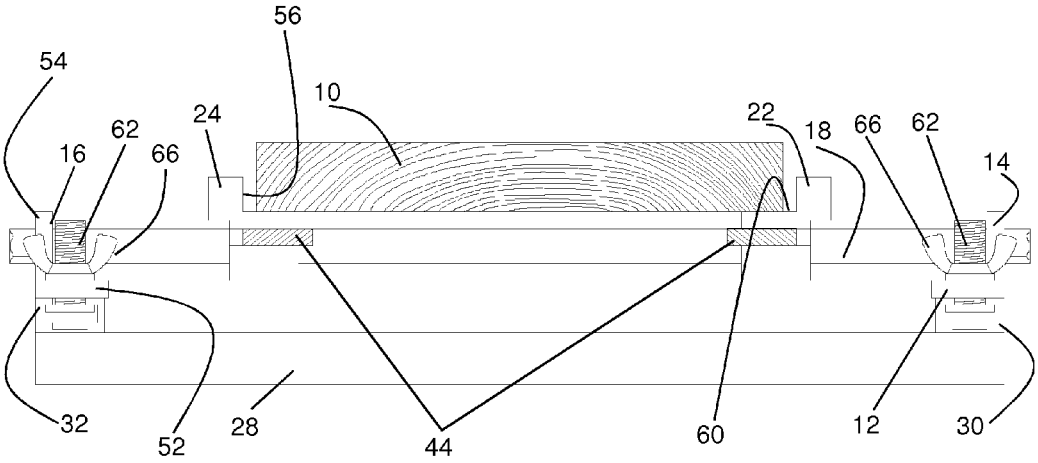
FIG. 12 is a front view of a planer clamp assembly according to an embodiment of the present invention.

Referring now to FIG. 12, the operation of planer clamp assembly 12 will be described in greater detail. FIG. 12 illustrates a front view of planer clamp assembly 12 just after placement of wood 10 on clamps 22, 24. Prior to placing wood 10 in clamp assembly 12, clamps 22, 24 may be positioned at an estimated width of wood 10 so that the wood may be easily placed on the clamps. With the wood now in place on the clamps, rod 26 may be rotated such that levelers 40*a*, 40*b*, 40*c*, 40*d* of clamps 22, 24 may be positioned under wood 10. One should be careful to avoid rotating rod 26 so that the clamps fully engage the wood at this time. Fully locking wood 10 to clamp assembly 12 at this time will not allow for proper adjustment of the levelers to provide adequate contact between the wood and levelers to provide for a generally flat top surface.

With both wood 10 and clamps 22, 24 positioned such that levelers may move freely to engage the wood, thumb screws 44 may be rotated to position the head of screw 42 at the bottom surface of wood 10 to diminish any wobbling or rocking that may be induced by a warped piece of rough sawn lumber. With the head of screws 42 positioned and a satisfactory amount of rocking or wobbling eliminated, rod 26 may be rotated further so that clamps 22, 24 fully engage wood 10 as depicted in FIG. 10. Wood 10 and planer clamp assembly 12 are now ready to be run through planer 34.

Typically, a piece of wood or lumber may be very long, longer than the length of a single clamp assembly 12 and the surface or mounting table 36 of planer 34. In this instance, as stated previously, multiple clamp assemblies 12 may be assembled to carrier board 28 such that clamp assemblies 12 may be used to secure and position any length of board as shown in FIG. 8. Support stands 38 may be added at either side of planer 34 so that a length of lumber may always be supported while moving through planer 34. Support of the lumber while completing the planing operation is critical to ensure a smooth level top surface is produced in the wood.

Figure 13:
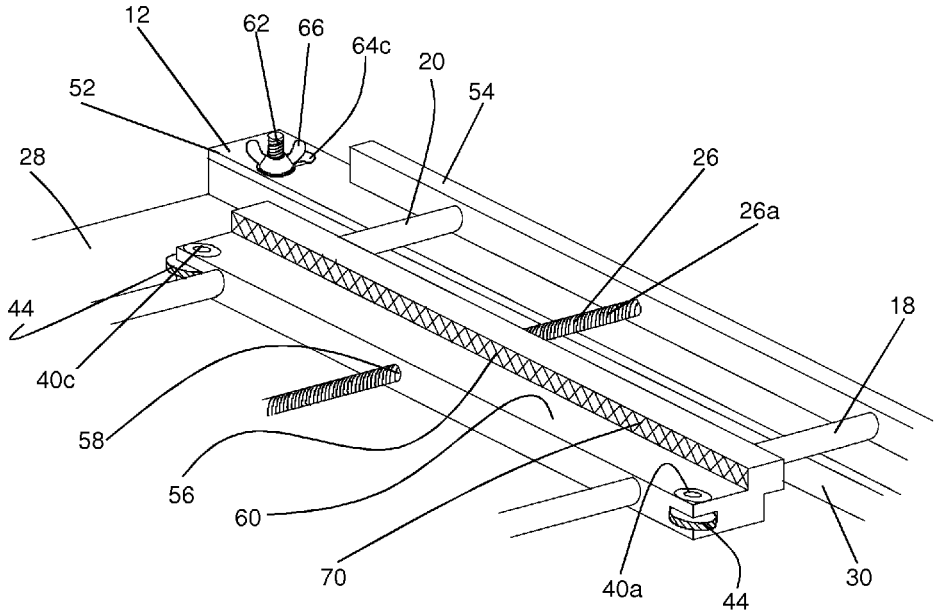
FIG. 13 is a perspective view of a portion of the planer clamp assembly according to an embodiment of the present invention.

Clamping edge 56 of clamps 22, 24 is depicted in FIG. 13 with a rough surface 70. The rough surface may be used to further enhance the engagement of clamping edge 56 with wood 10. Rough surface 70 may be manufactured of any material and applied to clamping edge 56 with adhesive or tape. Alternatively, a rough surface may be ground directly into the face of clamping edge 56.

Figure 14:
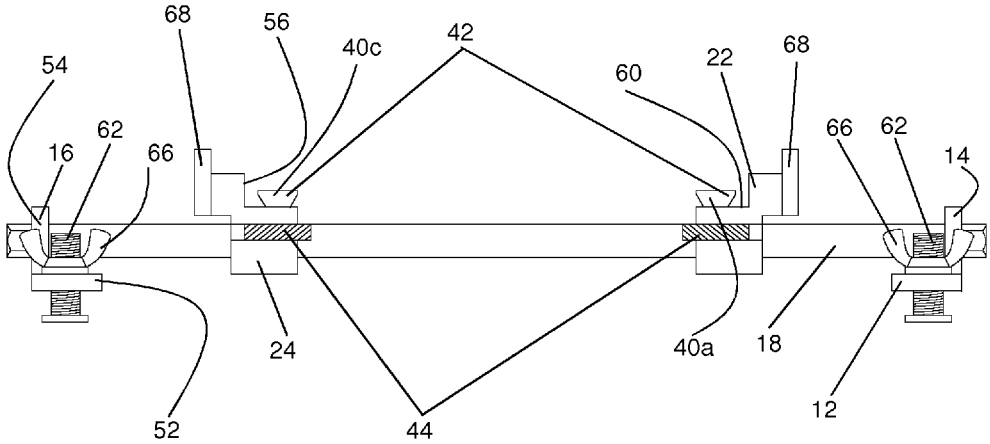
FIG. 14 is a front view of a planer clamp assembly according to another embodiment of the present invention.
Figure 15:
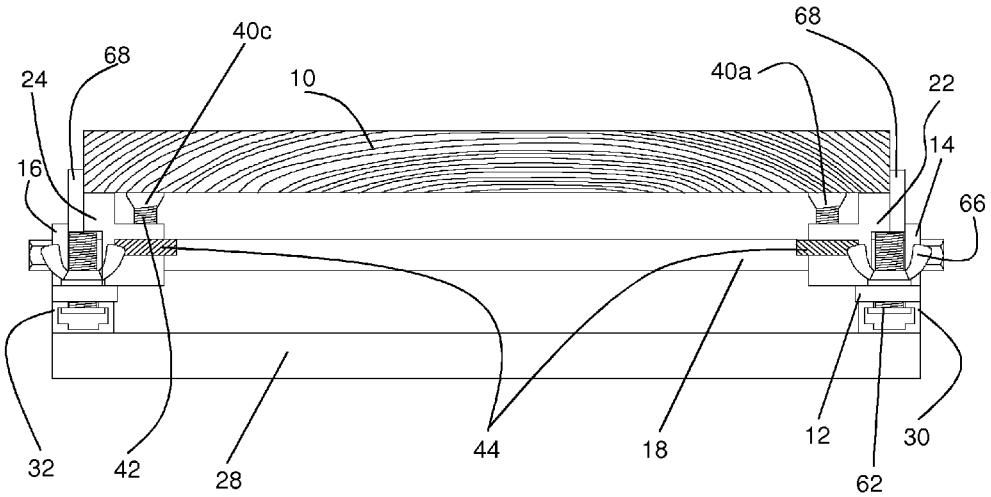
FIG. 15 is a front view of the planer clamp assembly according to an embodiment of the present invention.
Figure 16:
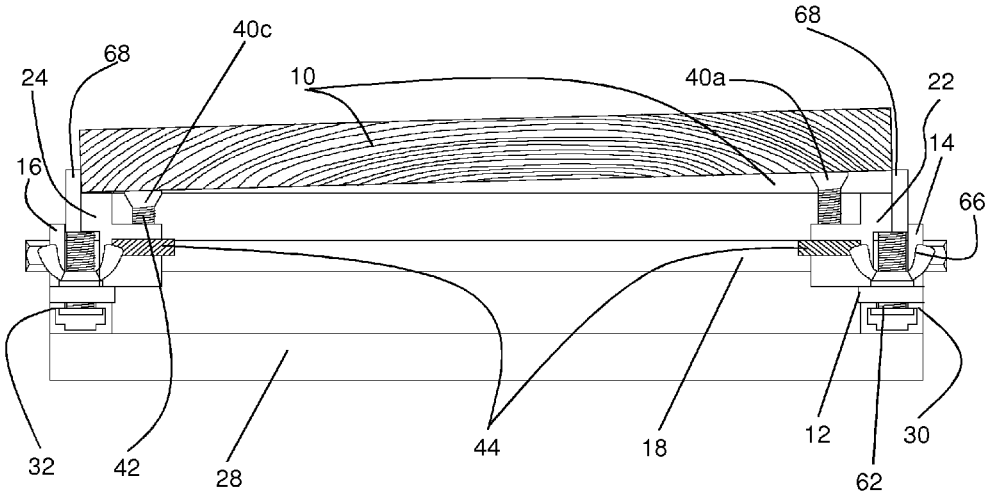
FIG. 16 is a front view of the planer clamp assembly according to an embodiment of the present invention.
Figure 17:
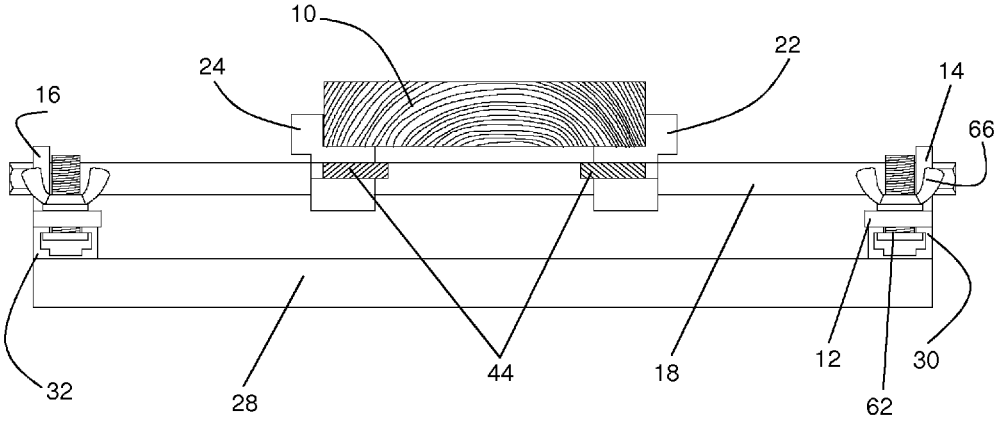
FIG. 17 is a front view of the planer clamp assembly according to an embodiment of the present invention.

FIGS. 14-16 illustrate an extension 68 that may be added to clamps 22, 24 according to another embodiment of the present invention. In this particular embodiment of the present invention, extension 68 may be secured to clamps 22, 24 at an outside of clamping edge 56 to increase the width of clamps so that a wider piece of wood may be secured to clamp assembly 12. Extensions 68 may be secure to clamps 22, 24 with any typical fasteners and may be used to enable clamping assembly 12 to accept wider pieces of wood. FIG. 16 illustrates a piece of wood shown clamped securely in position by extensions 68 and levelers 40*a*, 40*c*. FIG. 16 depicts a piece of wood that is slightly warped such that leveler 40*a* is raised to engage an edge of the piece of wood and extensions are shown in a position that secures the wood to clamp assembly 12. Alternatively, FIG. 17 illustrates a piece of lumber having a narrow width and the positioning of clamps 22, 24 to engage wood 10.

Planer clamp assembly 12 has been described above to illustrate how one may use the planer clamp assembly in cooperation with wood planer 34 to produce an initial top surface or datum in the piece of lumber. The clamping and leveling features of clamp assembly 12 are also advantageous for use with other tools such as a belt sander, drill, jig saw and the like. Planer clamp assembly 12 and the clamping and leveling features described above may limit the amount of human interaction or operator involvement that may otherwise be required when developing the datum surface using a jointer. Clamp assembly 12, when used in cooperation with wood planer 34, will aid the wood worker by producing improved datum surfaces in the wood while, allowing for larger initial pieces of rough sawn lumber to be milled, reducing the time to complete projects and reducing overall waste.

Although planer clamp assembly 12 has been described above using a piece of wood or lumber, it is important to note, however, that planer clamp assembly 12 may be use to secure and position any type of material such as metal, any number of different plastic compositions, ceramics, stone and the like. Securing and positioning any number of different materials in this manner will enable one to mill the surfaces of the different materials much like the surface of a piece of lumber, or, alternatively, other tools may be used such as a drill, jigsaw, belt sander and the like. The clamping and positioning features of planer clamp assembly 12 also allow one to have both hands free so that tools may be used safely and effectively.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A planer clamp assembly comprising:

a pair of side rails;

a pair of clamps, each of said clamps including at least one hole;

at least one leveler, said leveler including a screw and a cam, said cam including a lobe and said cam being configured to raise and lower said screw in a generally perpendicular direction with respect to said clamps when said cam is rotated about a generally parallel axis with respect to said clamps;

at least one bar; and wherein said bar is configured to be secured between said pair of side rails and said holes of said pair of clamps are configured to slidably accept said bar thereby allowing said pair of clamps to slide freely about said bar between said pair of side rails.

2. The planer clamp assembly as described in claim 1, wherein said pair of side rails each include a base plate and a wall.

3. The planer clamp assembly as described in claim 1, wherein said pair of clamps further include a top surface and a clamping edge.

4. The planer clamp assembly as described in claim 3, wherein each of said clamping edges of said pair of clamps include a rough surface.

5. The planer clamp assembly as described in claim 1, further including a threaded rod that is configured to be captured between said pair of side rails and capable of rotating freely.

6. The planer clamp assembly as described in claim 5, wherein said pair of clamps each include at least one threaded hole for accepting said threaded rod; and wherein said pair of clamps are drawn inward toward each other when said threaded rod is rotated in a first direction and said pair of clamps move away from each other when said threaded rod is rotated in a second direction.

7. The planer clamp assembly as described in claim 1, wherein said pair of side rails are configured to be positioned and secured to a carrier board.

8. The planer clamp assembly as described in claim 1, wherein said leveler includes a screw and a thumb screw.

9. The planer clamp assembly as described in claim 1, wherein said leveler includes a rack and a pinion.

10. The planer clamp assembly as described in claim 1, wherein said leveler includes a screw and said pair clamps include a divot to provide clearance for said screw as said screw is rotated clockwise and counter clockwise about said pair of clamps.

11. The planer clamp assembly as described in claim 1, further including a pair of extensions that may be configured to be secured to said pair of clamps.

12. A planer clamp assembly for positioning and securing a piece of wood comprising:

a pair of side rails, each of said side rails including a base plate and a wall;

a pair of clamps, each of said clamps including a top surface, a clamping edge, a pair of holes and a threaded hole;

a pair of bars;

at least one leveler, said leveler including a screw and a cam, said cam including a lobe and said cam being configured to raise and lower said screw in a generally perpendicular direction with respect to said clamps when said cam is rotated about a generally parallel axis with respect to said clamps;

a threaded rod;

wherein said bars are configured to be secured between said pair of side rails and said pair of holes of said pair of clamps are configured to slidably accept said bars thereby allowing said pair of clamps to slide freely about said bars between said pair of side rails; and wherein said pair of clamps are drawn inward toward each other when said threaded rod is rotated in a first direction and said pair of clamps move away from each other when said threaded rod is rotated in a second direction.

13. The planer clamp assembly as described in claim 12, wherein said leveler includes a screw and a thumb screw.

14. The planer clamp assembly as described in claim 12, wherein said leveler includes a rack and a pinion.

15. The planer clamp assembly as described in claim 12, wherein said leveler includes a screw and said pair clamps include a divot to provide clearance for said screw as said screw is rotated clockwise and counter clockwise about said pair of clamps.

16. The planer clamp assembly as described in claim 12, further including a pair of extensions that may be configured to be secured to said pair of clamps.

17. The planer clamp assembly as described in claim 12, wherein each of said clamping edges of said pair of clamps may include a rough surface.

* * * * *